US010357704B2

(12) United States Patent
Vigiano

(10) Patent No.: US 10,357,704 B2
(45) Date of Patent: Jul. 23, 2019

(54) DUMBBELL WITH REVOLVING COUNTERWEIGHT TO PROVIDE UPRIGHT ORIENTATION FOR A LOGO AND WEIGHT-NUMBER

(71) Applicant: James Allen Vigiano, Herrin, IL (US)

(72) Inventor: James Allen Vigiano, Herrin, IL (US)

( * ) Notice: Subject to any disclaimer, the term of this patent is extended or adjusted under 35 U.S.C. 154(b) by 114 days.

(21) Appl. No.: 15/794,224

(22) Filed: Oct. 26, 2017

(65) Prior Publication Data

US 2019/0126124 A1 May 2, 2019

(51) Int. Cl.

| | |
|---|---|
| ***A63B 21/00*** | (2006.01) |
| ***A63B 23/12*** | (2006.01) |
| ***A63B 71/06*** | (2006.01) |
| ***A63B 21/072*** | (2006.01) |

(52) U.S. Cl.

CPC ..... *A63B 71/0619* (2013.01); *A63B 21/0726* (2013.01); *A63B 21/4035* (2015.10); *A63B 21/4043* (2015.10); *A63B 23/12* (2013.01); *A63B 2071/0694* (2013.01)

(58) Field of Classification Search

CPC . A63B 71/0619; A63B 21/4035; A63B 23/12; A63B 21/0726; A63B 21/4043; A63B 2071/0694

See application file for complete search history.

(56) References Cited

U.S. PATENT DOCUMENTS

| | | | | |
|---|---|---|---|---|
| 3,998,099 | A * | 12/1976 | Chadwick | G01K 1/045 374/194 |
| 4,029,312 | A * | 6/1977 | Wright | A63B 21/0602 482/106 |
| 4,579,337 | A * | 4/1986 | Uyeda | A63B 21/0728 482/107 |
| 4,618,142 | A * | 10/1986 | Joseph, Jr. | A63B 5/20 482/106 |
| 5,421,797 | A * | 6/1995 | Fletcher | A63B 21/072 482/106 |
| 6,387,021 | B1 * | 5/2002 | Miller, Jr. | A63B 21/0728 482/98 |
| 6,468,166 | B1 * | 10/2002 | Spitzer | A63B 69/3632 473/241 |
| 6,702,723 | B2 * | 3/2004 | Landfair | A63B 21/06 482/106 |
| 6,736,765 | B2 * | 5/2004 | Wallace | A63B 21/072 482/106 |

(Continued)

*Primary Examiner* — Garrett K Atkinson

(57) ABSTRACT

A dumbbell with revolving counterweight to keep upright a logo and weight-number includes a first side weight, a second side weight, a handle bar, a first spindle weighted assembly, and a second spindle weighted assembly. The first side weight and the second side weight are terminally connected to the handle bar as each side weight comprises a body, an outer surface, and a circular cavity. The circular cavity concentrically traverses into the body from the outer surface so that a rotatable body and a cover plate of the first and second spindle weighted assembly can be concentrically and rotatably mounted to the circular cavity by a shoulder bolt of the first and second spindle weighted assembly. A counter weight of the rotatable body maintains the upright orientation for the cover plate to outwardly display a logo section and a weight-number section that respectively displays the logo and the weight-number.

8 Claims, 6 Drawing Sheets

(56) References Cited

U.S. PATENT DOCUMENTS

| | | | | |
|---|---|---|---|---|
| 6,971,974 | B2 * | 12/2005 | Bowman | A63B 21/0728 482/106 |
| 7,246,384 | B2 * | 7/2007 | Bentz | A42B 3/08 2/421 |
| 7,704,197 | B2 * | 4/2010 | Yu | A63B 21/063 482/108 |
| 8,025,613 | B1 * | 9/2011 | Wang | A63B 21/0726 482/107 |
| 8,047,971 | B2 * | 11/2011 | Parker | A63B 21/0726 482/104 |
| 8,287,438 | B2 * | 10/2012 | Krull | A63B 21/0628 482/98 |
| 8,506,460 | B2 * | 8/2013 | Seitzer | A63B 21/4015 482/106 |
| 8,545,340 | B2 * | 10/2013 | Roach | A63B 53/00 473/219 |
| 8,888,606 | B2 * | 11/2014 | Boccieri | A63B 60/24 473/297 |
| 2007/0249475 | A1 * | 10/2007 | Cao | A63B 21/0728 482/107 |
| 2011/0059808 | A1 * | 3/2011 | Roach | A63B 53/00 473/238 |
| 2012/0021877 | A1 * | 1/2012 | Lundquist | A63B 21/0728 482/107 |
| 2012/0302364 | A1 * | 11/2012 | Boccieri | A63B 60/24 473/300 |
| 2015/0045136 | A1 * | 2/2015 | Boccieri | A63B 60/24 473/297 |
| 2015/0367163 | A1 * | 12/2015 | Moran | A63B 21/075 482/108 |
| 2016/0166873 | A1 * | 6/2016 | Liu | A63B 21/0726 482/107 |

* cited by examiner

DUMBBELL WITH REVOLVING COUNTERWEIGHT TO PROVIDE UPRIGHT ORIENTATION FOR A LOGO AND WEIGHT-NUMBER

FIELD OF THE INVENTION

The present invention relates generally to a free weight that is used in weight training. More specifically, the present invention is a fixed-weight dumbbell, barbell, or curl bar apparatus that seeks self-leveling position for a logo and a weight-number during usage and placement in a dumbbell rack.

BACKGROUND OF THE INVENTION

The dumbbell is type of free weight that is used in weight training as it can be used individually or in pairs depending upon the type of exercise. In order to account for many different exercises and user requirements, actual weight of the dumbbell normally ranges from 5 pounds to 150 pounds. The weight number of the fixed-weight dumbbell is generally shown in the both side weights of the dumbbell so that the users can identify the correct weight for each dumbbell. However, after usage and placement back to the dumbbell rack, the weight number arbitrarily land on the dumbbell rack at random position or many random orientations, more often than not, leaving the weight number in a position that is hard to read or possibly even totally hidden. If the dumbbells display a company logo or custom artworks, the dumbbells can be affected with the same aforementioned problem thus creating an unattractive surrounding. Since the aforementioned problems can apply for many different dumbbells, users or employees of a commercial gym have to continuously rearranged these fixed-weight dumbbells in order to keep upright that weight number and/or logo of the fixed-weight dumbbell. Since the rearrangement of fixed-weight dumbbells is time consuming, users can lose valuable time that can be utilized for exercising and commercial gym have to allocate labor cost that can be utilized to improve the facility.

It is therefore an objective of the present invention to provide a dumbbell with revolving counterweight to keep upright a logo and weight-number. More specifically, the present invention utilizes gravitational force to keep upright the logo and weight-number during usage and storage of the dumbbells. A counterweight plate that is rotatably and removably mounted to each side of the fixed-weight dumbbell by a shoulder bolt allows the logo and weight-number to revolve around the shoulder bolt. Since, the logo and weight-number always stays upright and display as they are originally intended to do so, the present invention eliminates labor cost/time for commercial gyms and saves time for users.

DETAIL DESCRIPTIONS OF THE INVENTION

All illustrations of the drawings are for the purpose of describing selected versions of the present invention and are not intended to limit the scope of the present invention.

Figure 1:
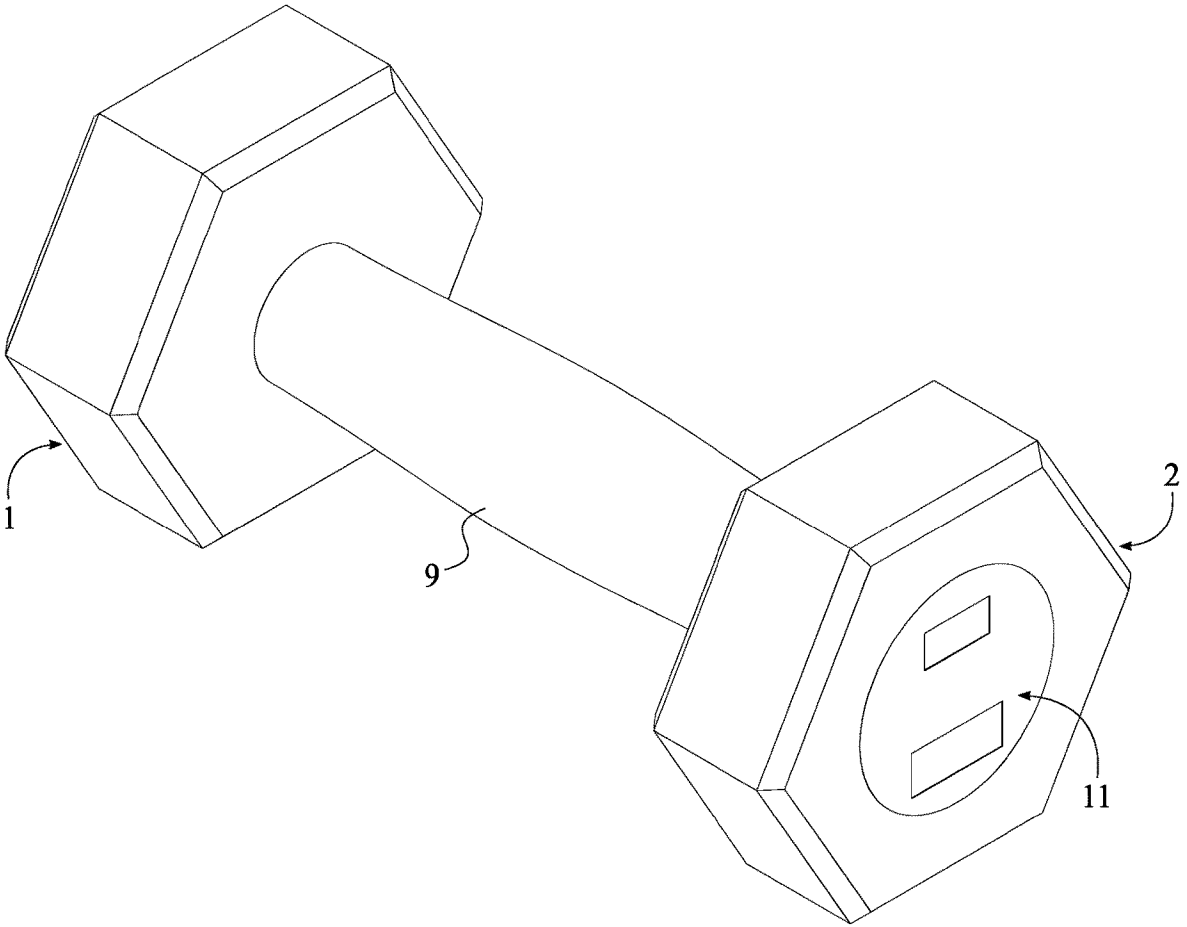
FIG. 1 is a perspective view of the present invention.
Figure 2:
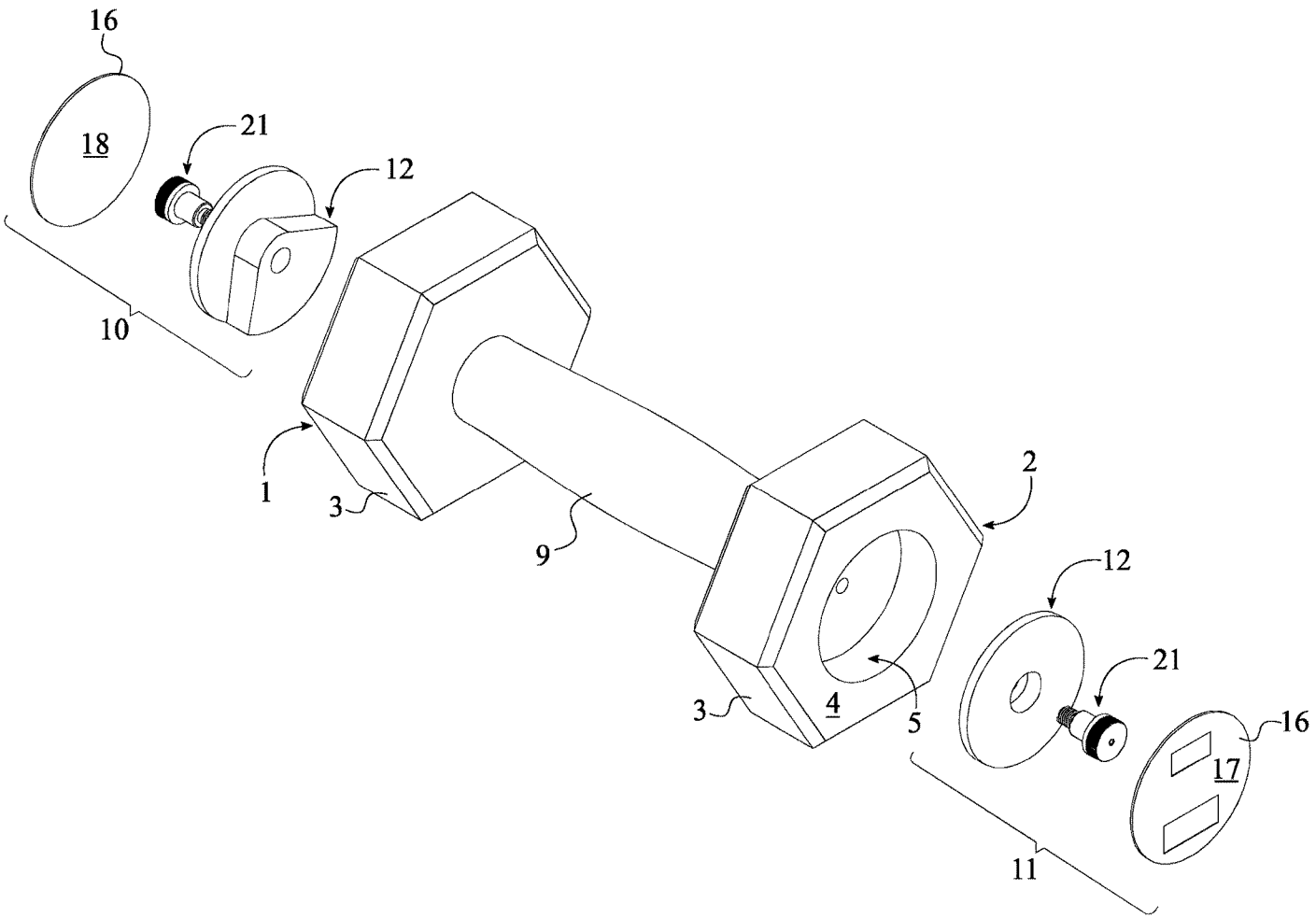
FIG. 2 is an exploded perspective view of the present invention.
Figure 3:
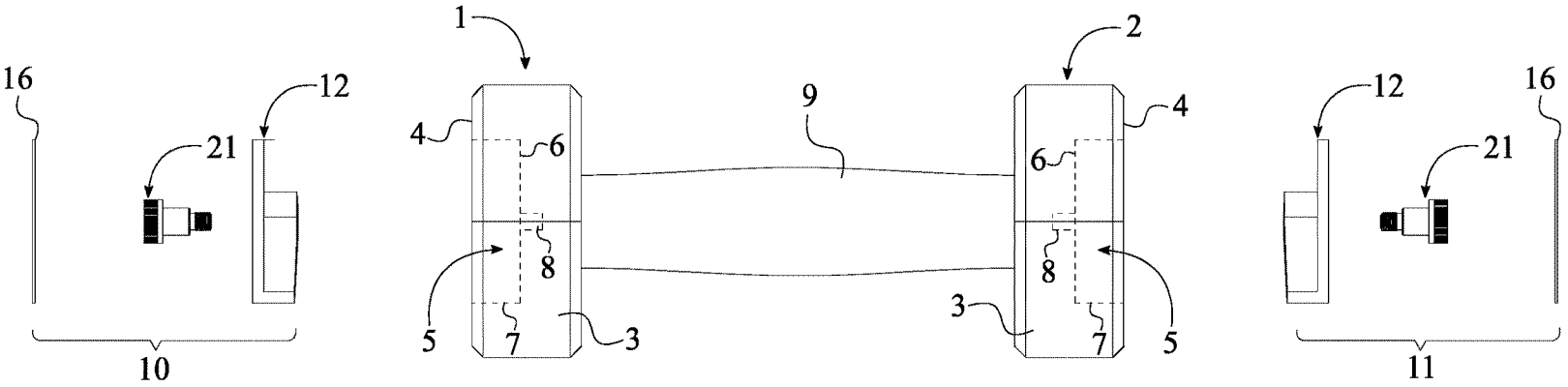
FIG. 3 is an exploded side view of the present invention.

The present invention is a dumbbell with revolving counterweight to keep upright a logo and a weight-number. More specifically, the logo and the weight-number of the dumbbell continuously stay upright during usage of the present invention and during storage of the present invention. As a result, the present invention is able to eliminate additional labor cost and time that are normally associated with traditional fixed-weight dumbbells. In other words, gym employees generally rearrange the traditional fixed-weight dumbbells after usage so that the respective weight-number can be displayed in an upright position. However, the present invention provides a solution to this problem by continuously maintaining the upright position to the logo and the weight-number. The present invention comprises a first side weight 1, a second side weight 2, a handle bar 9, a first spindle weighted assembly 10, and a second spindle weighted assembly 11 as shown in FIG. 1-3. In reference to general configuration of the present invention, the first side weight 1 and the second side weight 2 are terminally connected to the handle bar 9 thus resembling the traditional appearance of a dumbbell. The first spindle weighted assembly 10 is rotatably mounted to a circular cavity 5 of the first side weight 1 and positioned opposite to the handle bar 9. The second spindle weighted assembly 11 is rotatably mounted to a circular cavity 5 of the second side weight 2 and positioned opposite to the handle bar 9.

The first side weight 1 and the second side weight 2 each comprises a body 3 and an outer surface 4, in addition to the circular cavity 5 as shown in FIG. 2-3. An inner surface of the first side weight 1 and the second side weight 2 are connected to the handle bar 9 thus resembling a traditional dumbbell. The body 3 of the first side weight 1 and the second side weight 2 are formed similar to traditional side weights of a dumbbell. For example, the body 3 of the first side weight 1 and the second side weight 2 can be formed into many different geometric shapes including, but is not limited to, circular shapes, square shapes, hexagonal shapes, and octagonal shapes. The circular cavity 5 concentrically traverses into the body 3 from the outer surface 4. Resultantly, the circular cavity 5 and handle bar 9 are oppositely positioned of each other about the body 3. More specifically, the circular cavity 5 of the first side weight 1 is positioned opposite of the handle bar 9 and oriented outward from the dumbbell to receive the first spindle weighted assembly 10. The circular cavity 5 of the second side weight 2 is positioned opposite of the handle bar 9 and oriented outward from the dumbbell to receive the second spindle weighted assembly 11. Additionally, the first side weight 1 and the second side weight 2 have weight ratio of 1:1 so that the present invention is able to provide a balance dumbbell.

In reference to FIG. 3, the first spindle weighted assembly 10 and the second spindle weighted assembly 11 each comprises a rotatable body 12, a cover plate 16, and a shoulder bolt 21. The rotatable body 12 is concentrically mounted to the circular cavity 5 by the shoulder bolt 21. The cover plate 16 is adjacently positioned to the outer surface 4 and perimetrically superimposed onto the rotatable body 12. Resultantly, the rotatable body 12 continuously rotates around the shoulder bolt 21 thus maintaining the upright position for the cover plate 16 that visually illustrates the logo and the weight-number of the present invention.

Figure 5:
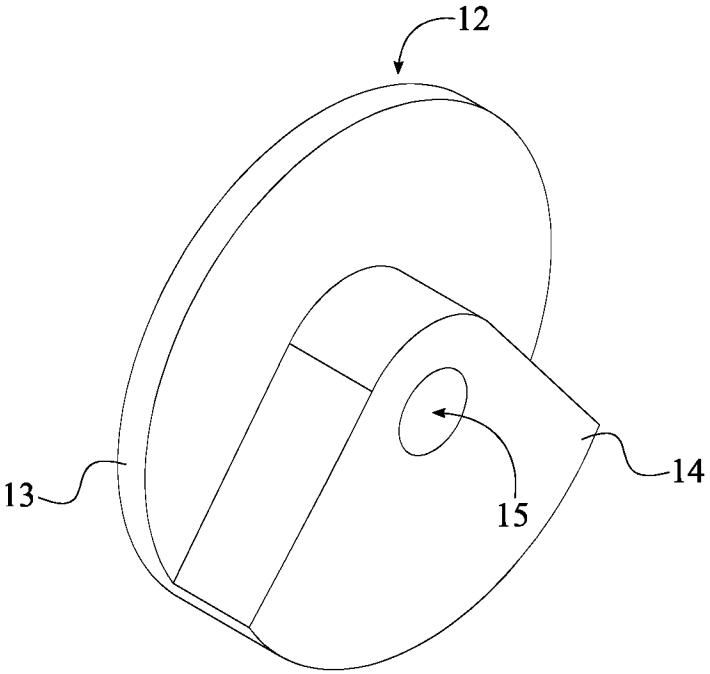
FIG. 5 is a rear perspective view of the rotatable body of the present invention.
Figure 4:
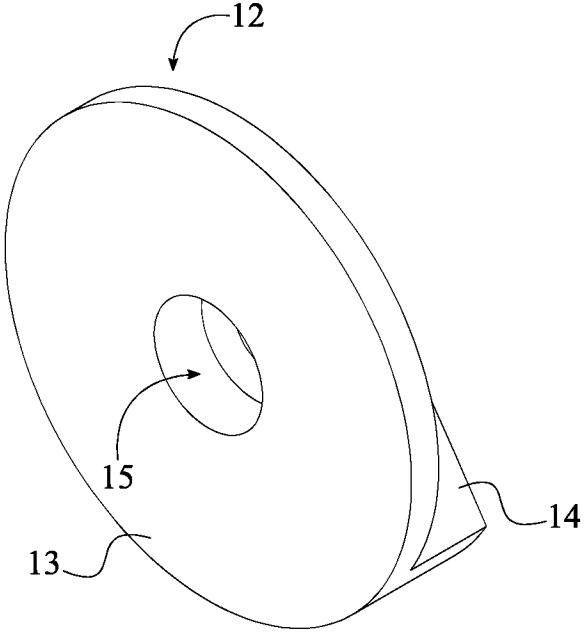
FIG. 4 is a front perspective view of the rotatable body of the present invention.

The rotatable body 12, which maintain the upright position of the logo and the weight-number, comprises a circular plate 13, a counter weight 14, and an opening 15 as shown in FIG. 4-5. The counter weight 14, which creates an unbalance weight distribution within the rotatable body 12, is adjacently connected to the circular plate 13. The opening 15 provides a center hole for rotatable body 12 so that the rotatable body 12 can freely rotate around the shoulder bolt 21. More specifically, the opening 15 is concentrically positioned to the circular plate 13 and traverses through the circular plate 13 and counter weight 14. As a result, the circular plate 13 and the counter weight 14 can freely rotate around the shoulder bolt 21 as the counter weight 14 always orients toward the ground surface, resulting the upright position for the cover plate 16.

Figure 6:
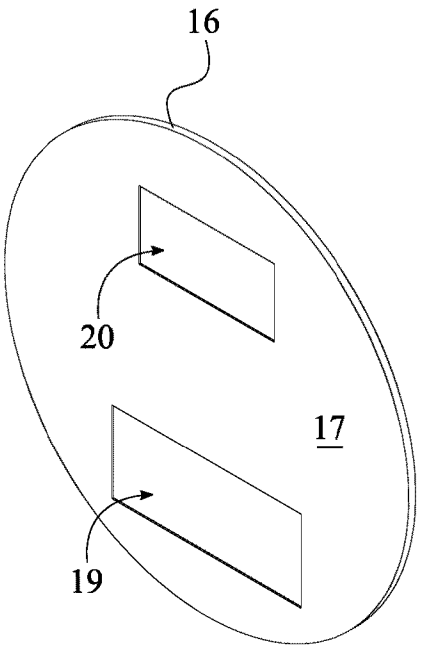
FIG. 6 is a perspective view of the cover plate of the present invention.

In reference to FIG. 6, a logo section 19 of the present invention provides specific area within the cover plate 16 so that the cover plate 16 is able to demonstrate the logo within the present invention. For example, the logo can be a custom artwork, a company logo, or any other types of graphics. More specifically, the logo section 19 is adjacently positioned on an exterior surface 17 of the cover plate 16 so that the logo can be displayed within the present invention. As the counter weight 14 maintains the upright position to the rotatable body 12 and the cover plate 16, the logo section 19 is able to maintain a left-to-right (sinistrodextral) illustration for the logo.

In reference to FIG. 6, a weight-number section 20 of the present invention provides specific area within the cover plate 16 so that the cover plate 16 is able to demonstrate the weight-number within the present invention. More specifically, the weight-number section 20 is adjacently positioned on an exterior surface 17 of the cover plate 16 so that the weight-number can be displayed within the present invention. As the counter weight 14 maintains an upright position to the rotatable body 12 and the cover plate 16, the weight-number section 20 is able to maintain a left-to-right (sinistrodextral) illustration of alphabetical writing for the weight-number. For example, a 35 pounds dumbbell displays "35" on the weight-number section 20.

Figure 7:
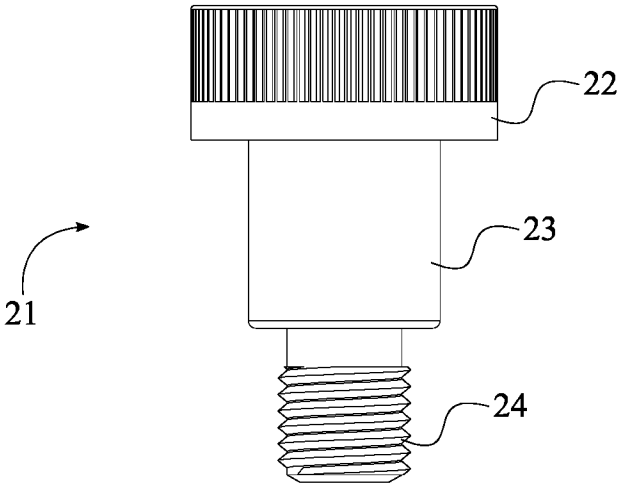
FIG. 7 is a side view of the shoulder bolt of the present invention.

The shoulder bolt 21 that mounts the rotatable body 12 to the circular cavity 5 comprises a head 22, a shank section 23, and a threaded section 24 as shown in FIG. 7. The head 22, the shank section 23, and the threaded section 24 are concentrically positioned of each other thus providing a liner arrangement between them. More specifically, the head 22 is terminally connected to the shank section 23. The threaded section 24 is terminally connected to the shank section 23 and positioned opposite of the head 22. The specific arrangement between the head 22, the shank section 23, and the threaded section 24 are critical to rotational movement of the rotatable body 12 as each component has its unique functionality.

The placement of the rotatable body 12 within the circular cavity 5 is shown in FIG. 1-3. More specifically, the counter weight 14 is adjacently positioned to a bottom surface 6 of the circular cavity 5. The circular plate 13 is concentrically positioned within a lateral surface 7 of the circular cavity 5 and offset of the bottom surface 6. Due to the shape of the circular cavity 5 and the circular plate 13, the opening 15 is concentrically aligned with a bottom opening 8 of the circular cavity 5. The attachment of the rotatable body 12 to the circular cavity 5 by the shoulder bolt 21 is shown in FIG. 1-3. More specifically, the head 22 is positioned flush with the circular plate 13 thus concentrically positioning the shank section 23 within the opening 15. Furthermore, the head 22 is countersunk into the opening 15 and positioned coplanar with the circular plate 13. The threaded section 24 is connected to the bottom opening 8, securing the rotatable body 12 to the circular cavity 5. The head 22 is enclosed by the cover plate 16 as an interior surface 18 of the cover plate 16 is adjacently positioned and pressed against the circular plate 13 and the head 22. For example, the cover plate 16 can be mounted through a plurality of fasteners, fasten through adhesive, or secured through any other types of fastening mechanisms. As a result, the logo section 19 and the weight-number section 20 are oriented in the upright position all the time.

Due to the configuration of the first spindle weighted assembly 10 and the second spindle weighted assembly 11, the present invention is able to maintain the upright position for the logo and the weight-number with respect to the first side weight 1 and the second side weight 2. As a result, the cover plate 16 seeks self-leveling properties through the gravitational force acting upon the counter weight 14 and continuously displays the logo and the weight-number in as sinistrodextral illustrations during usage and storage.

Although the invention has been explained in relation to its preferred embodiment, it is to be understood that many other possible modifications and variations can be made without departing from the spirit and scope of the invention as hereinafter claimed.

What is claimed is:

1. A dumbbell with revolving counterweight to keep upright a logo and weight-number comprises:

a first side weight;

a second side weight;

a handle bar;

a first spindle weighted assembly;

a second spindle weighted assembly;

the first side weight and the second side weight each comprises a body, an outer surface, and a circular cavity;

the first spindle weighted assembly and the second spindle weighted assembly each comprises a rotatable body, a cover plate, and a shoulder bolt;

the first side weight and the second side weight being terminally connected to the handle bar;

the first spindle weighted assembly is rotatably mounted to the circular cavity of the first side weight, opposite to the handle bar; and the second spindle weighted assembly is rotatably mounted to the circular cavity of the second side weight, opposite to the handle bar.

2. The dumbbell with revolving counterweight to keep upright a logo and weight-number as claimed in claim 1 comprises:

the circular cavity and the handle bar being oppositely positioned of each other about the body; and the circular cavity concentrically traverses into the body from the outer surface.

3. The dumbbell with revolving counterweight to keep upright a logo and weight-number as claimed in claim 1 comprises:

the rotatable body comprises a circular plate, a counter weight, and an opening;

the counter weight being adjacently connected to the circular plate;

the opening being concentrically positioned to the circular plate; and the opening traverses through the circular plate and the counter weight.

4. The dumbbell with revolving counterweight to keep upright a logo and weight-number as claimed in claim 1 comprises:

a logo section; and the logo section being adjacently positioned on an exterior surface of the cover plate.

5. The dumbbell with revolving counterweight to keep upright a logo and weight-number as claimed in claim 1 comprises:

a weight-number section; and the weight-number section being adjacently positioned on an exterior surface of the cover plate.

6. The dumbbell with revolving counterweight to keep upright a logo and weight-number as claimed in claim 1 comprises:

the shoulder bolt comprises a head, a shank section, and a threaded section;

the head, the shank section, and the threaded section being concentrically positioned of each other;

the head being terminally connected to the shank section; and the threaded section being terminally connected to the shank section, opposite of the head.

7. The dumbbell with revolving counterweight to keep upright a logo and weight-number as claimed in claim 1 comprises:

the rotatable body being concentrically mounted within the circular cavity by the shoulder bolt;

the cover plate being adjacently positioned to the outer surface; and the cover plate being perimetrically superimposed onto the rotatable body.

8. The dumbbell with revolving counterweight to keep upright a logo and weight-number as claimed in claim 7 comprises:

the rotatable body comprises a circular plate, a counter weight, and an opening;

the shoulder bolt comprises a head, a shank section, and a threaded section;

the counter weight being adjacently positioned to a bottom surface of the circular cavity;

the circular plate being concentrically positioned within a lateral surface of the circular cavity;

the circular plate being offset of the bottom surface;

the head being positioned flush with the circular plate;

the shank section being concentrically positioned within the opening;

the threaded section being connected to a bottom opening of the circular cavity; and an interior surface of the cover plate being adjacently positioned to the circular plate and the head.

* * * * *